US006769426B2

(12) United States Patent
Fier et al.

(10) Patent No.: US 6,769,426 B2
(45) **Date of Patent: *Aug. 3, 2004**

(54) INDOOR-OUTDOOR FIREPLACE

(75) Inventors: Jane Catherine Fier, Prior Lake, MN (US); David Charles Lyons, Red Wing, MN (US); Robb Edward Bennett, New Prague, MN (US)

(73) Assignee: HON Technology Inc., Muscatine, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/442,804

(22) Filed: May 21, 2003

(65) Prior Publication Data

US 2003/0196651 A1 Oct. 23, 2003

Related U.S. Application Data

(63) Continuation of application No. 10/008,369, filed on Nov. 13, 2001, now Pat. No. 6,601,579.

(51) Int. Cl.[7] ..... F24C 3/00; F24B 1/189

(52) U.S. Cl. ..... 126/512; 126/510; 126/528; 126/531; 431/125

(58) Field of Search ..... 126/512, 510, 126/509, 289, 290, 515, 523, 529, 531, 307 R, 312; 431/125

(56) References Cited

U.S. PATENT DOCUMENTS

| | | | | |
|---|---|---|---|---|
| 2,915,960 | A | * 12/1959 | McClellan, Jr. | 99/421 H |
| 4,256,083 | A | * 3/1981 | Wilson | 126/516 |
| 4,793,322 | A | * 12/1988 | Shimek et al. | 126/80 |
| 5,016,609 | A | * 5/1991 | Shimek et al. | 126/85 B |
| 5,076,254 | A | * 12/1991 | Shimek et al. | 126/512 |
| 5,738,084 | A | * 4/1998 | Hussong | 126/512 |
| 6,145,502 | A | * 11/2000 | Lyons et al. | 126/512 |
| 6,237,588 | B1 | 5/2001 | Hawkinson | |
| 6,601,579 | B2 | * 8/2003 | Fier et al. | 126/512 |

* cited by examiner

*Primary Examiner*—James C. Yeung
(74) *Attorney, Agent, or Firm*—Merchant & Gould P.C.

(57) ABSTRACT

A fireplace for concurrent use inside and outside of a structure includes a combustion chamber enclosure defining a combustion chamber, an inside opening, and an outside opening, wherein the combustion chamber is viewable from the inside of the structure through the inside opening and from the outside of the structure through the outside opening. The fireplace also includes a combustion air plenum system coupled to the combustion chamber enclosure to supply fresh air from the outside to the combustion chamber and an exhaust opening defined by the combustion chamber enclosure for exhausting exhaust air from the combustion chamber to the outside of the structure.

12 Claims, 15 Drawing Sheets

INDOOR-OUTDOOR FIREPLACE

"This application is a continuation of application Ser. No. 10/008,369, filed Nov. 13, 2001, now U.S. Pat. No. 6,601, 579 which application is incorporated herein by reference."

FIELD OF THE INVENTION

The present invention relates to fireplaces. More particularly, the invention relates to a fireplace adapted for concurrent use both inside and outside of a structure.

BACKGROUND OF THE INVENTION

Fireplaces are an efficient method for providing warmth and creating the appeal of a fire. Fireplaces have become commonplace in today's building trades for both residential and commercial applications. Most new home construction designs include at least one, and often several fireplaces. Further, a significant number of remodeling projects are focused on fireplaces. Gas, electric, and wood-burning fireplaces are commonly installed to provide benefits such as heat and the aesthetic appeal of a fire.

A fireplace is typically installed either inside or outside of a structure in a wall of the structure or as a freestanding unit. In present installations, a fireplace is constructed and installed for use either inside or outside of the structure. Therefore, the benefits of a fireplace can be enjoyed indoors, if the fireplace is installed inside the structure, or outdoors, if the fireplace is installed outside. However, current fireplaces do not provide for both indoor and outdoor use. Because of this, individuals who desire the heating and aesthetic value of a fireplace must choose between indoor or outdoor use, or, alternatively, bear the added expense of installing multiple fireplace units.

Thus, there is a need for additional innovations in fireplace construction to provide the concurrent benefits of a fireplace to both the inside and the outside of a structure.

SUMMARY OF THE INVENTION

Generally, the present invention relates to fireplaces. More particularly, the invention relates to a fireplace adapted for concurrent use both inside and outside of a structure.

In one aspect, a fireplace for use inside and outside of a structure may include a combustion chamber enclosure defining a combustion chamber, an inside opening, and an outside opening, wherein the combustion chamber is viewable from the inside of the structure through the inside opening and from the outside of the structure through the outside opening; a combustion air plenum system coupled to the combustion chamber enclosure to supply fresh air from the outside to the combustion chamber; and an exhaust opening defined by the combustion chamber enclosure for exhausting exhaust air from the combustion chamber to the outside of the structure.

In another aspect, the invention relates to a fireplace for use inside and outside of a structure, the fireplace including a combustion chamber enclosure defining a combustion chamber, an inside opening directed toward the inside of the structure, and an outside opening directed toward the outside of the structure; insulation surrounding at least a portion of the combustion chamber enclosure to reduce an amount of outside air from the outside of the structure from entering the inside of the structure through the fireplace; a housing at least partially surrounding the combustion chamber enclosure, wherein the housing is sealed to reduce condensation entering the fireplace from the outside of the structure; a gas burner disposed within the combustion chamber enclosure; a combustion air plenum system including right and left air plenum panels defining right and left air plenum pathways in fluid communication with the outside of the structure, wherein the right and left air plenum pathways provide fresh air from the outside of the structure to the combustion chamber for combustion; and an exhaust opening defined by the housing at a position adjacent an upper portion of the combustion chamber, the exhaust opening exhausting exhaust air from the combustion chamber to the outside.

In another aspect, the invention relates to a method for operating a fireplace for use inside and outside of a structure, the method including the steps of: providing a combustion chamber enclosure defining a combustion chamber, an inside opening, and an outside opening, wherein the combustion chamber is viewable via the inside opening from the inside of the structure and via the outside opening from the outside of the structure; and providing a combustion air plenum system coupled to the combustion chamber enclosure, wherein the combustion air plenum system provides fresh air to the combustion chamber for combustion.

In another aspect, the invention relates to a combustion chamber enclosure for use inside and outside of a structure, the combustion chamber enclosure including a combustion chamber defined by the combustion chamber enclosure, the combustion chamber including an inside opening directed toward the inside of the structure and an outside opening directed toward the outside of the structure; and a burner disposed within the combustion chamber enclosure.

In another aspect, the invention relates to a fireplace for use inside and outside of a structure, the fireplace including a combustion chamber enclosure defining a combustion chamber, an inside opening, and an outside opening, wherein the combustion chamber is viewable from the inside of the structure through the inside opening and from the outside of the structure through the outside opening; a burner disposed within the combustion chamber enclosure; a means for supplying fresh air from the outside of the structure; and a means for exhausting exhaust air from the combustion chamber to the outside of the structure.

The above summary of the present invention is not intended to describe each disclosed embodiment or every implementation of the present invention. Figures in the detailed description that follow more particularly exemplify embodiments of the invention. While certain embodiments will be illustrated and describing embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

While the invention is amenable to various modifications and alternant forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENTS

The invention is applicable to fireplaces. In particular, the invention is directed to a fireplace adapted for concurrent use both inside and outside of a structure. While the present invention is not so limited, an appreciation of the various aspects of the invention will be gained through a discussion of the examples provided below.

A fireplace made in accordance with this invention generally includes a combustion chamber enclosure defining a combustion chamber including an inside opening viewable from an inside of a structure and an outside opening viewable from an outside of the structure. It will be understood that, as used herein, the term "combustion chamber enclosure" can be any structure that at least partially surrounds the portion of the fireplace, or the combustion chamber, in which combustion occurs and may be created using one or more panels. Further, the phrase "inside of the structure" will be understood to mean the interior or inner portion of any structure, such as a house or office building or other structure providing at least partial protection from the elements. The phrase "outside of the structure" will be understood to mean the exterior or outer portion of any structure, which is typically exposed to various weather elements such as rain, snow, wind, etc. It should also be noted that, although the embodiments of the present invention disclosed herein are illustrated with burners connected to a combustible gas supply, the present invention may alternatively apply to other fireplaces, such as, for example, wood-burning fireplaces and electric fireplaces.

Figure 1:
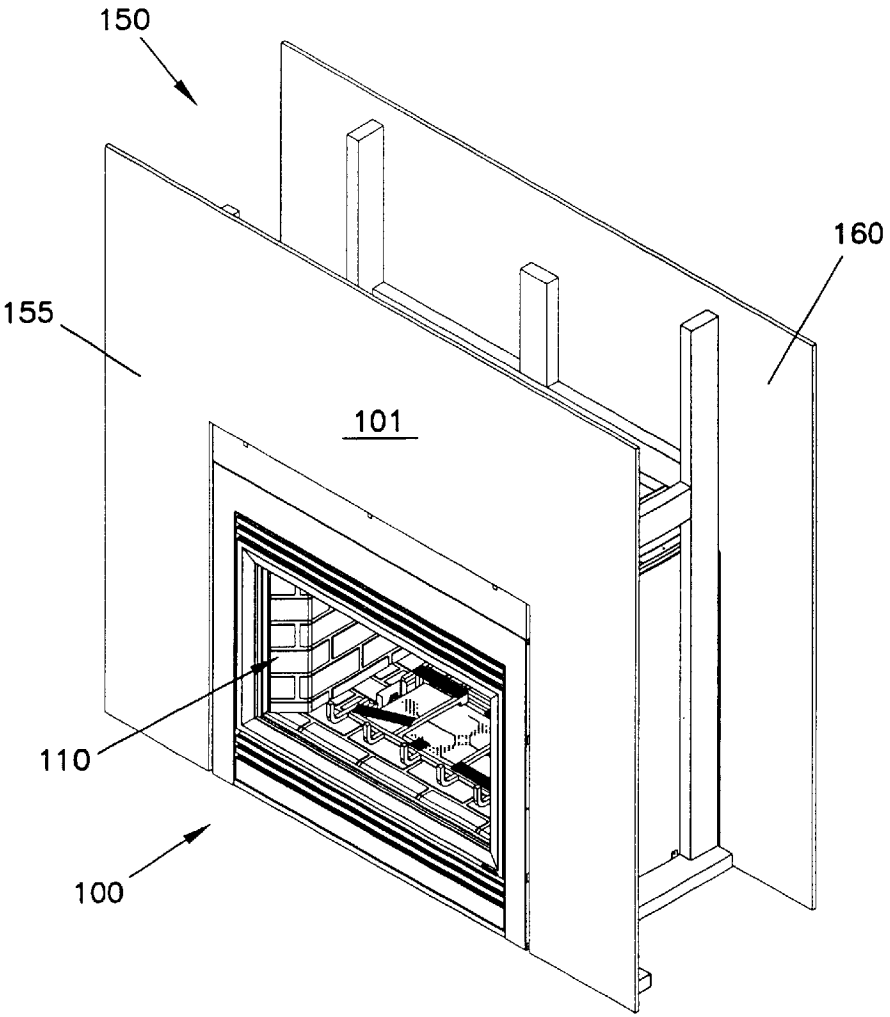
FIG. 1 is a perspective schematic view, taken from an inside of a structure, of one exemplary embodiment of a fireplace installed in a wall of the structure in accordance with the present invention.
Figure 2:
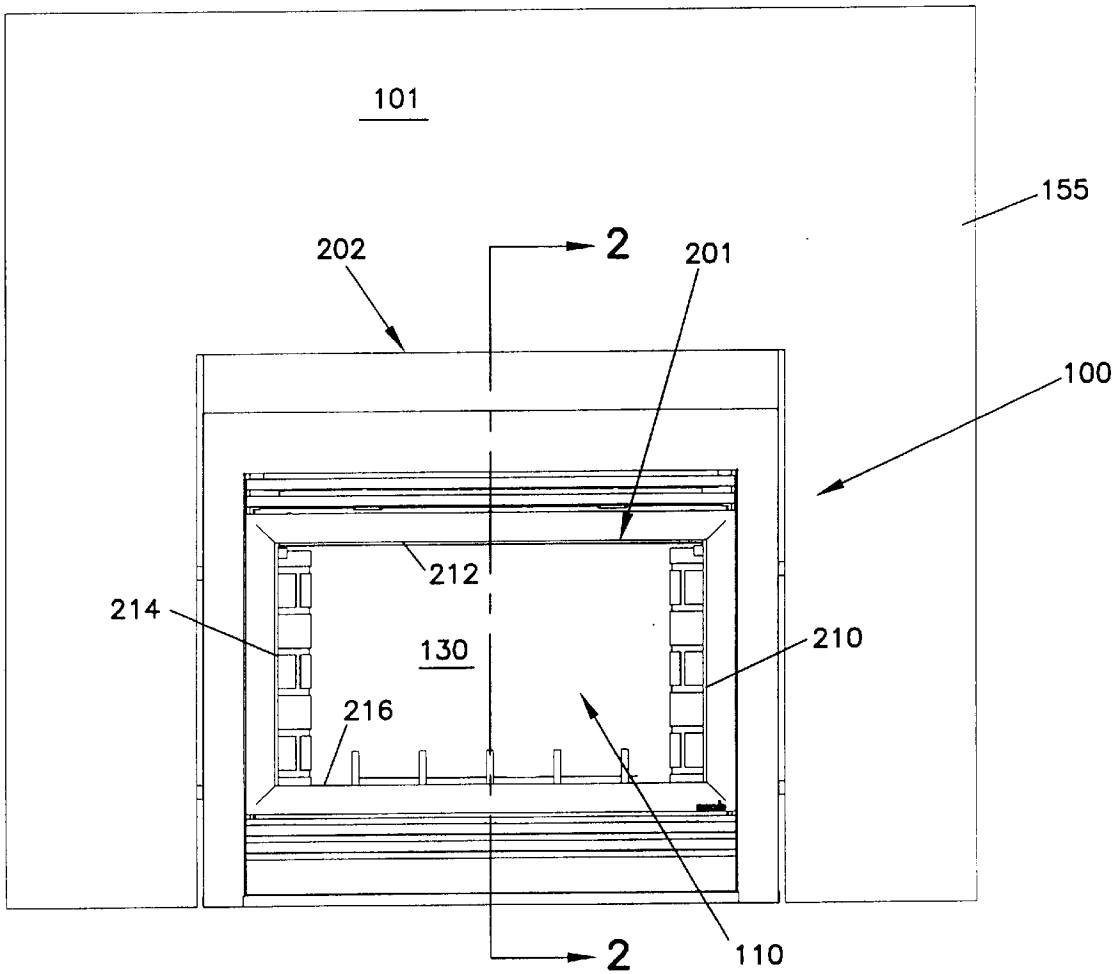
FIG. 2 is a front schematic view, taken from the inside of the structure, of the fireplace of FIG. 1.
Figure 3:
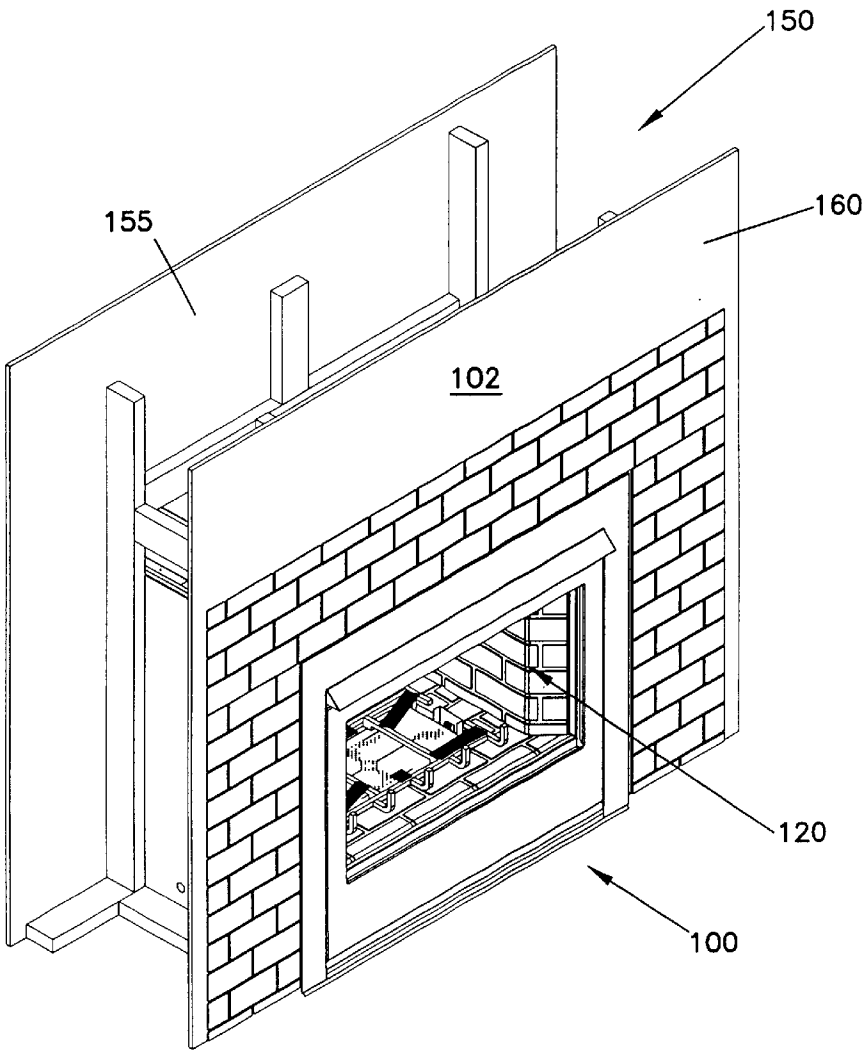
FIG. 3 is a perspective schematic view, taken from an outside of the structure, of the fireplace shown in FIG. 1.
Figure 4:
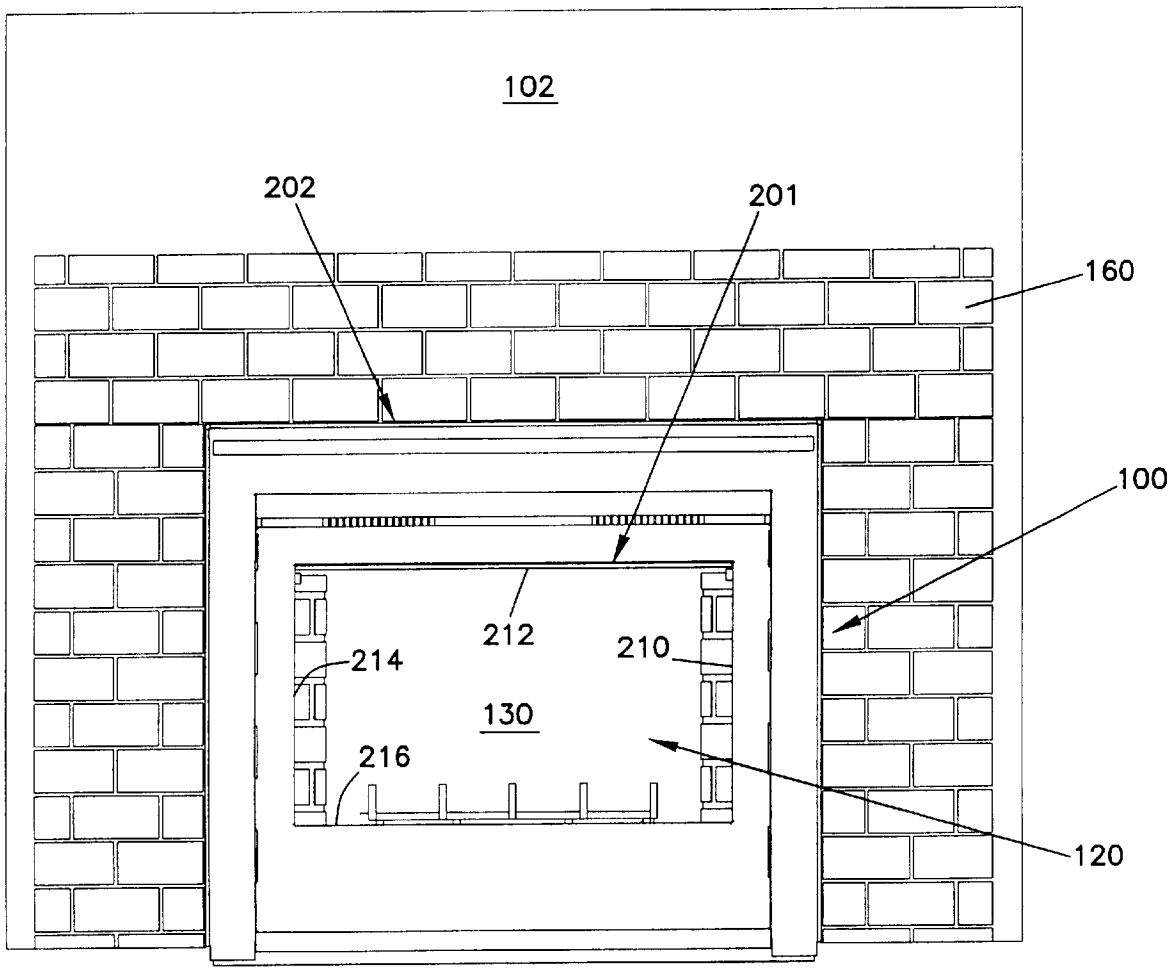
FIG. 4 is a front schematic view, taken from the outside of the structure, of the fireplace of FIG. 1.

Referring now to FIGS. 1–5, a first exemplary embodiment of a fireplace 100 made in accordance with the present invention is shown installed within a wall 150 of a structure. In FIGS. 1 and 2, perspective and front views of the fireplace 100 are shown as installed along an inside panel 155 of the wall 150. The inside panel 155 faces an inside of the structure 101. In FIGS. 3 and 4, perspective and front views of the fireplace 100 are shown as installed along an outside panel 160 of the wall 150. The outside panel 160 faces an outside of the structure 102.

The fireplace 100 may be installed within the wall 150 in any conventional method, such as by framing an enclosure to hold the fireplace 100 to provide a close tolerance fit between the fireplace 100 and the wall 150 to protect against wind, water, and pest infiltration. Alternatively, the fireplace 100 may instead be disposed within the wall 150 in a freestanding formation.

The fireplace 100 includes a combustion chamber enclosure 201. The combustion chamber enclosure 201 comprising panels 210, 212, 214, and 216, as well as an inside front panel 281 and an outside front panel 282 that together define a combustion chamber 130. Although the combustion chamber enclosure 201, as shown, includes six panels, it should be understood that more or less than six panels may be used to create the combustion chamber enclosure 201. A housing 202, the components of which are defined in greater detail below, surrounds portions of the combustion chamber enclosure 201.

The combustion chamber enclosure 201 defines an opening 110 facing the inside of the structure 101 and an opening 120 facing the outside of the structure 102. The openings 110 and 120 are defined on opposite sides of the combustion chamber 130. In this manner, the combustion chamber 130 extends through the wall 150 and is visible from both the inside of the structure 101 and the outside of the structure 102.

Figure 5:
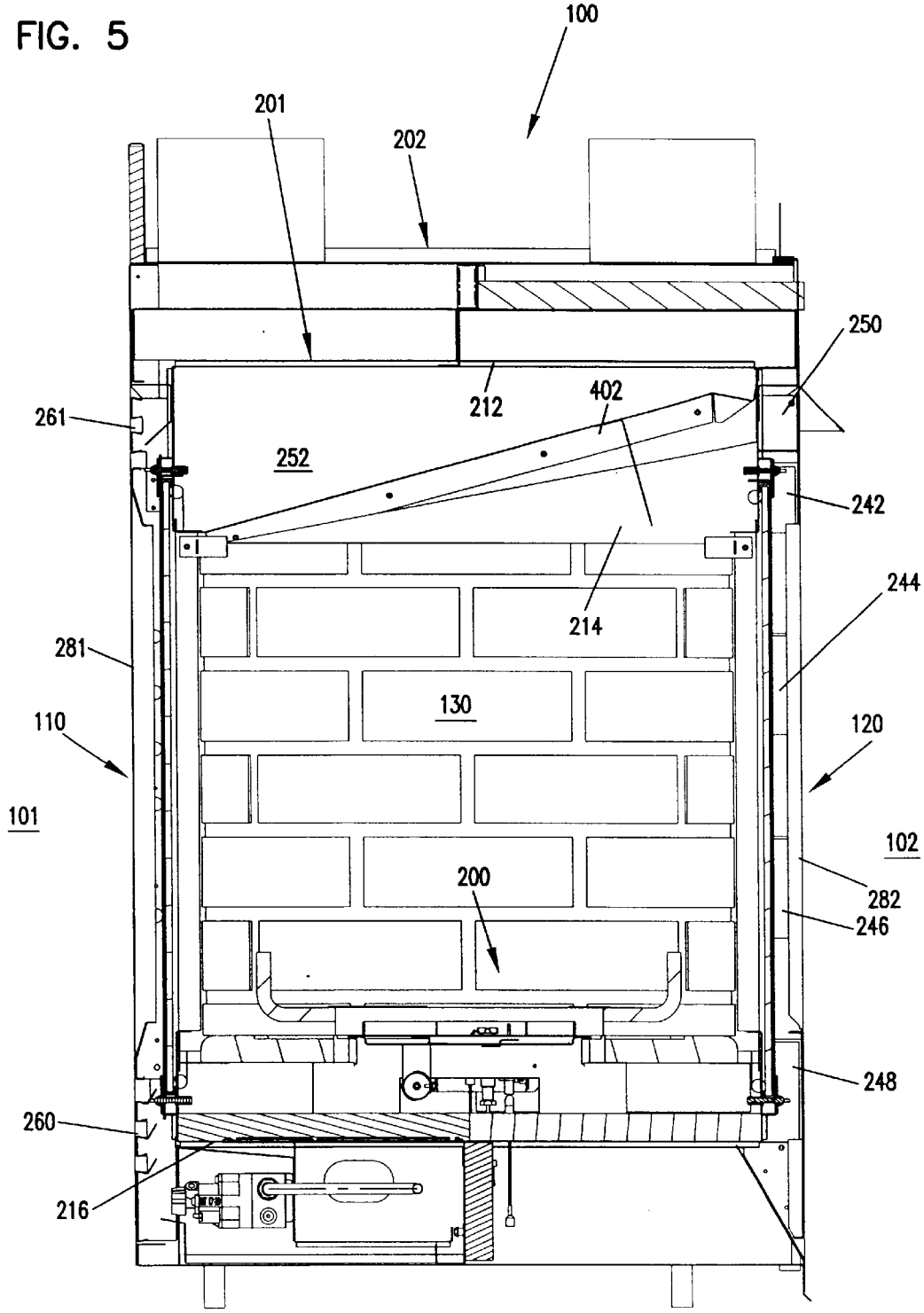
FIG. 5 is a cross-sectional schematic view of the fireplace taken along line 2—2 of FIG. 2.

A side cross-sectional view of the fireplace 100 is shown in FIG. 5 taken along line 2—2 of FIG. 2. A burner 200 is generally disposed within the fireplace 100 to provide combustion of gas within the combustion chamber 130. Also included in the fireplace 100 are a series of openings 242, 244, 246, and 248 defined generally in the housing 202 of the fireplace 100. The openings 242, 244, 246, and 248 provide fluid communication between the outside of the structure 102 and a combustion air plenum system of the fireplace 100 to supply fresh air from the outside of the structure 102 to the burner 200 for combustion (see FIGS. 7–9 below for more detail on the combustion air plenum system). An exhaust opening 250 is defined generally by the combustion chamber enclosure 201 to provide fluid communication between the combustion chamber 130 and the outside of the structure 102.

Figure 6:
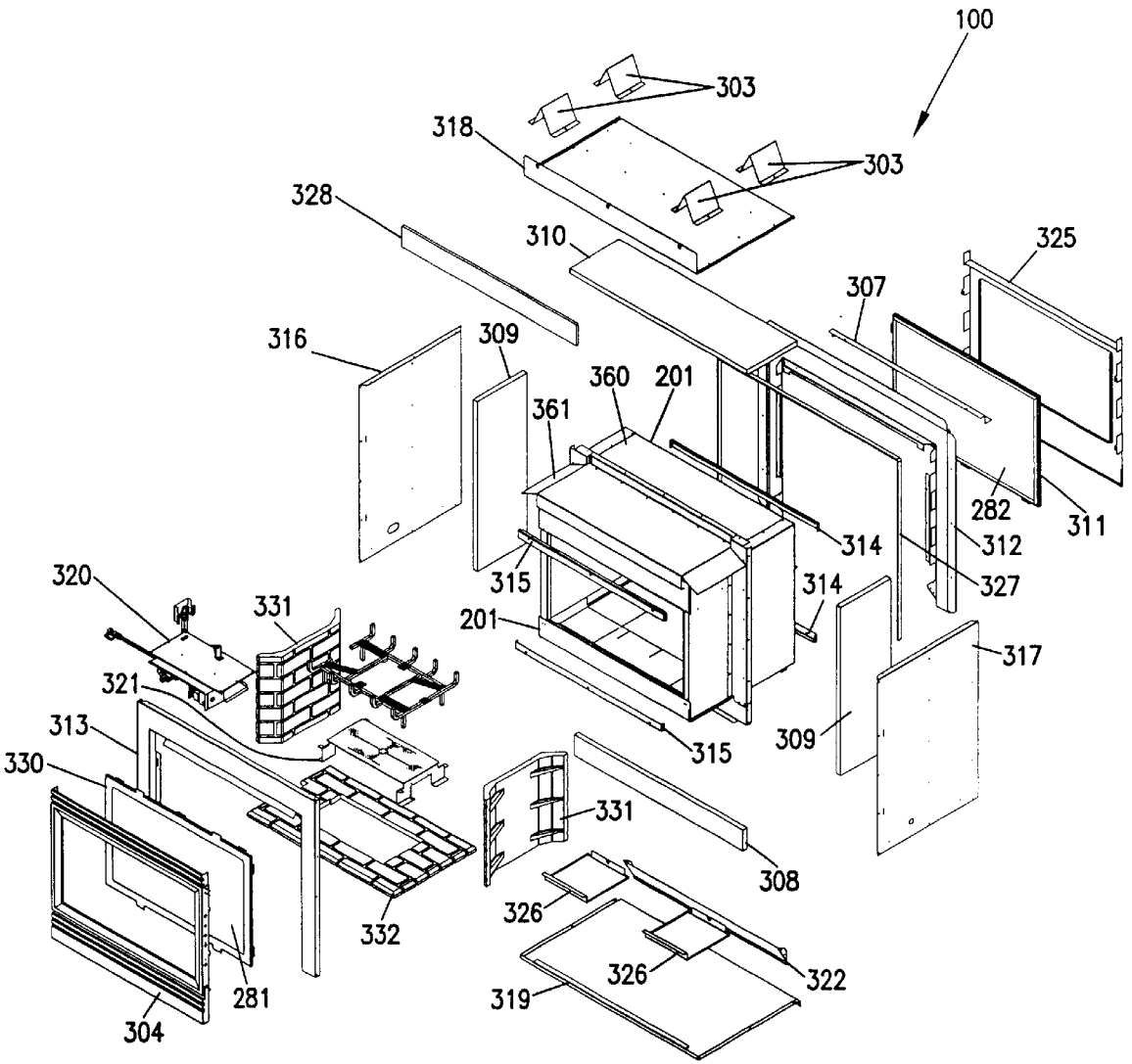
FIG. 6 is an exploded perspective schematic view of the fireplace of FIG. 1.

Referring now to FIG. 6, the various components comprising the fireplace 100, including the combustion chamber enclosure 201 and the housing 202, are shown in exploded perspective view. A portion 360 of the combustion chamber enclosure 201 (illustrated in greater detail in FIG. 7) is surrounded by insulation. This insulation includes outside side insulation panels 309 and outside bottom and top insulation panels 308 and 310. The insulation functions to reduce or eliminate cold air infiltration originating on the outside of the structure 102 from penetrating through the fireplace 100 into the inside of the structure 101. The insulation also shields the structure adjacent the fireplace 100 from the heat generated by the combustion in the fireplace 100. The insulation may be constructed using any typical insulation material, in this exemplary embodiment preferably fiberglass with binder insulation. In alternative embodiments, the fireplace 100 can be constructed without insulation panels. For example, if the combustion chamber enclosure 201 is formed using refractory ceramic fibers, using a method such as compression or vacuum molding, the refractory ceramic fiber material may insulate sufficiently without additional insulation being added to the fireplace 100.

Partially surrounding the combustion chamber enclosure 201 and generally forming the housing 202 are left and right side outerwrap panels 316 and 317 and top and base outerwrap panels 318 and 319. The panels 316, 317, 318, and 319 are coupled to one another, such as by welding or other similar method, to reduce the formation of condensation within and/or on the fireplace 100. Alternatively, the housing 202 may be formed as a single, continuous structure without separate panels. The housing 202 may further be formed with more or less than four panels, as desired.

Other components that may generally be considered to be part of the housing 202 include, an indoor surround 313 that is mounted to the combustion chamber enclosure 201 and an inside door 304, including an assembly 330, that is coupled to the surround 313. An outdoor surround 312 (shown in greater detail in FIG. 10) is coupled to the combustion chamber enclosure 201 via openings 480 and 481 (shown in FIG. 7), with a thermal break gasket 327 sandwiched between and in an engaging relationship with the combustion chamber enclosure 201 and the outdoor surround 312. A hood 307 is coupled to an upper portion of the surround 312. An outside door 325 (shown in greater detail in FIG. 11), including an assembly 311, is coupled to the surround 312. Outdoor and indoor glass clips 314 and 315 maintain the assemblies 330 and 311 in place. In the illustrated embodiment, the inside and outside doors are not 304 and 325 are not operable to allow access to the combustion chamber. However, in other embodiments, one or both of the doors, preferably the outside door 325, may be operable.

Drain pans 326 are positioned between the combustion chamber enclosure 201 and the outerwrap base panel 319. A deflection plate 322 is coupled to the outdoor surround 312 adjacent the base of the combustion chamber enclosure 201. In this configuration, the deflection plate 322 and the drain pans 326 deflect and channel any condensation that may enter the combustion chamber enclosure 201 away from the inside of the structure 101.

Top standoffs 303 are coupled to the top outerwrap panel 318 to provide spacing between the top portion of the fireplace 100 and any adjacent combustible material. An insulation board 328, made of non-combustible material, is coupled to the combustion chamber enclosure 201 and the top outerwrap panel 318 to allow combustible material to be mounted to the insulation board 328. For example, the insulation board 328 allows sheet rock to be mounted to it so that the fireplace 100 and the structure surrounding it may have a finished look.

Generally disposed within the combustion chamber enclosure 201 are a grate 305, rear and bottom refractory umbers 331 and 332, and the burner 200. The burner 200, illustrated in more detail in FIGS. 14 and 15, generally comprises a valve assembly 320 and a burner assembly 321. Other components, such as an artificial log set, an artificial ember bed, or an artificial flame system (none shown), may also be included within the combustion chamber enclosure 201 to be viewable from both the inside and the outside of the structure 101 and 102.

Figure 7:
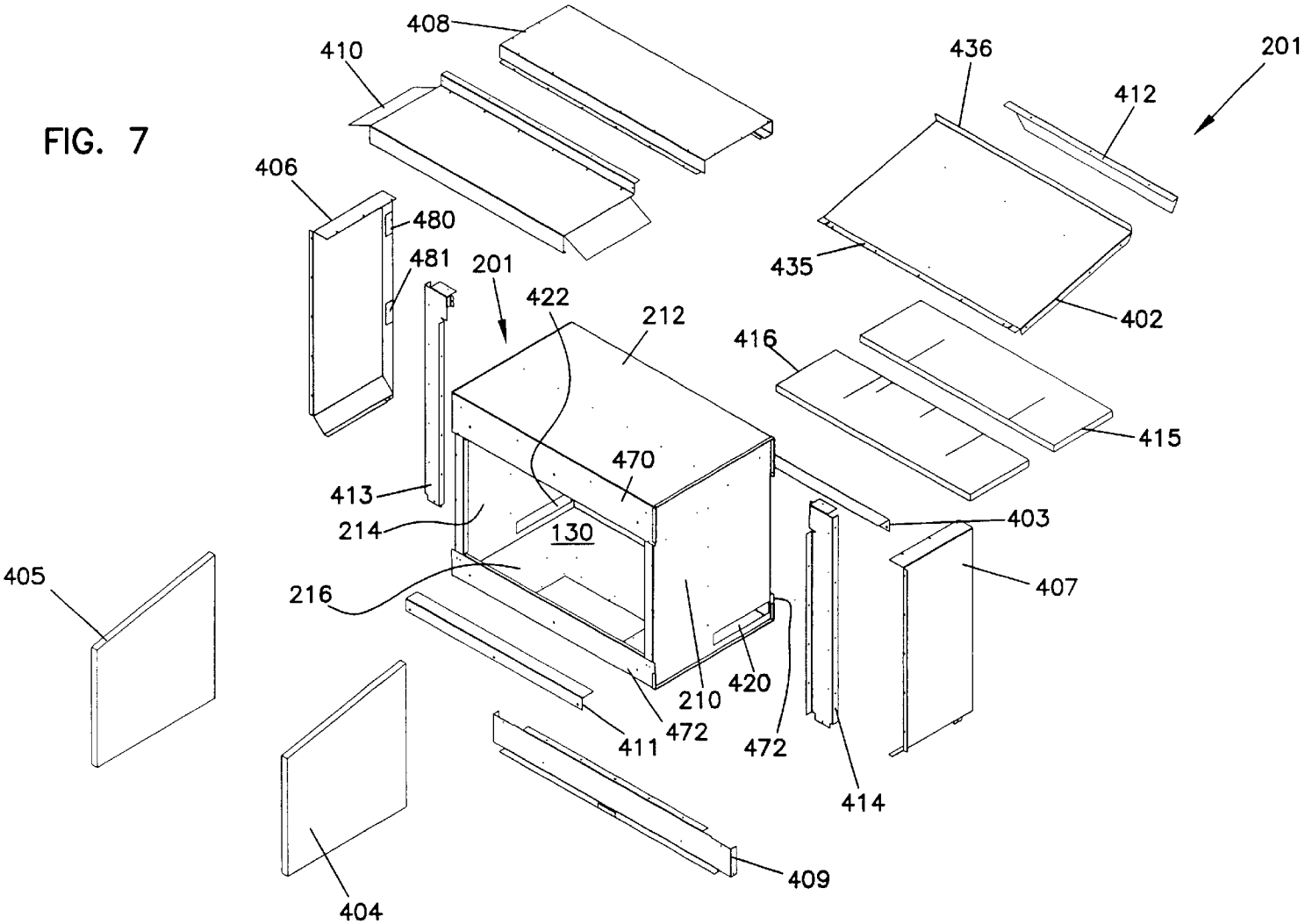
FIG. 7 is a perspective schematic view of the combustion chamber enclosure of FIG. 6 with various external components shown in exploded form.

A perspective view of the exemplary combustion chamber enclosure 201 with various adjacent components shown in exploded view are illustrated in FIG. 7. The panels 212 and 216 of the combustion chamber enclosure are formed with outer flanges 470 and 472 bent at about 90-degree angles with respect to the center portion of each panel. The panels 210, 212, 214, and 216 are coupled as shown to create the combustion chamber enclosure 201 surrounding the combustion chamber 130. The panels 210, 212, 214, and 216 may be coupled using a variety of methods, such as by welding the joints between adjacent panels or by bolts, screws, flanges, or other means. It should be understood that other configurations for the combustion chamber enclosure 201 are possible, such as a combustion chamber enclosure comprising more or fewer panels.

Additional insulation is coupled to the combustion chamber 201 in the form of right and left side firebox insulation panels 404 and 405 positioned adjacent to the panels 210 and 214, respectively. Outdoor and indoor bottom firebox insulation panels 415 and 416 are attached to the panel 216. These insulation panels, made preferably of fiberglass with binder insulation, limit the amount of cold air infiltration that penetrates from the outside of the structure 102, through the fireplace 100, and into the inside of the structure 101. The insulation also shields the structure surrounding the fireplace 100 from the heat generated by the fireplace 100. Alternatively, these insulation panels may not be necessary if, as described above, the combustion chamber enclosure 201 is formed using a material such as refractory ceramic fibers.

Right and left splines 414 and 413 are connected to the panels 210 and 214, respectively, to fix the insulation panels 309 in place. A bottom barrier 409 is coupled to the panel 216, to partially hold insulation panels 308 in place. A top heat shield 410 is coupled to the portion 361 of the combustion chamber enclosure 201 facing the inside of the structure 101 to direct heat away from any wall or other structure positioned adjacent the top of the fireplace 100. Bottom refractory brackets 403 and 411 are coupled to the combustion chamber enclosure 201 on the panel 216 to hold the bottom refractory umber 332 in place.

A baffle 402 is disposed within the combustion chamber 130 at an angle extending from a lowermost point 435 facing the inside of the structure 101 to a peak 436 facing the outside of the structure 102 near the exhaust opening 250. Attached adjacent this peak 436 is a baffle ridge 412. The baffle 402 and the baffle ridge 412 are positioned to direct combusted air from the burner system 200 up the baffle 402 and out the exhaust opening 250.

Figures 8, 9:
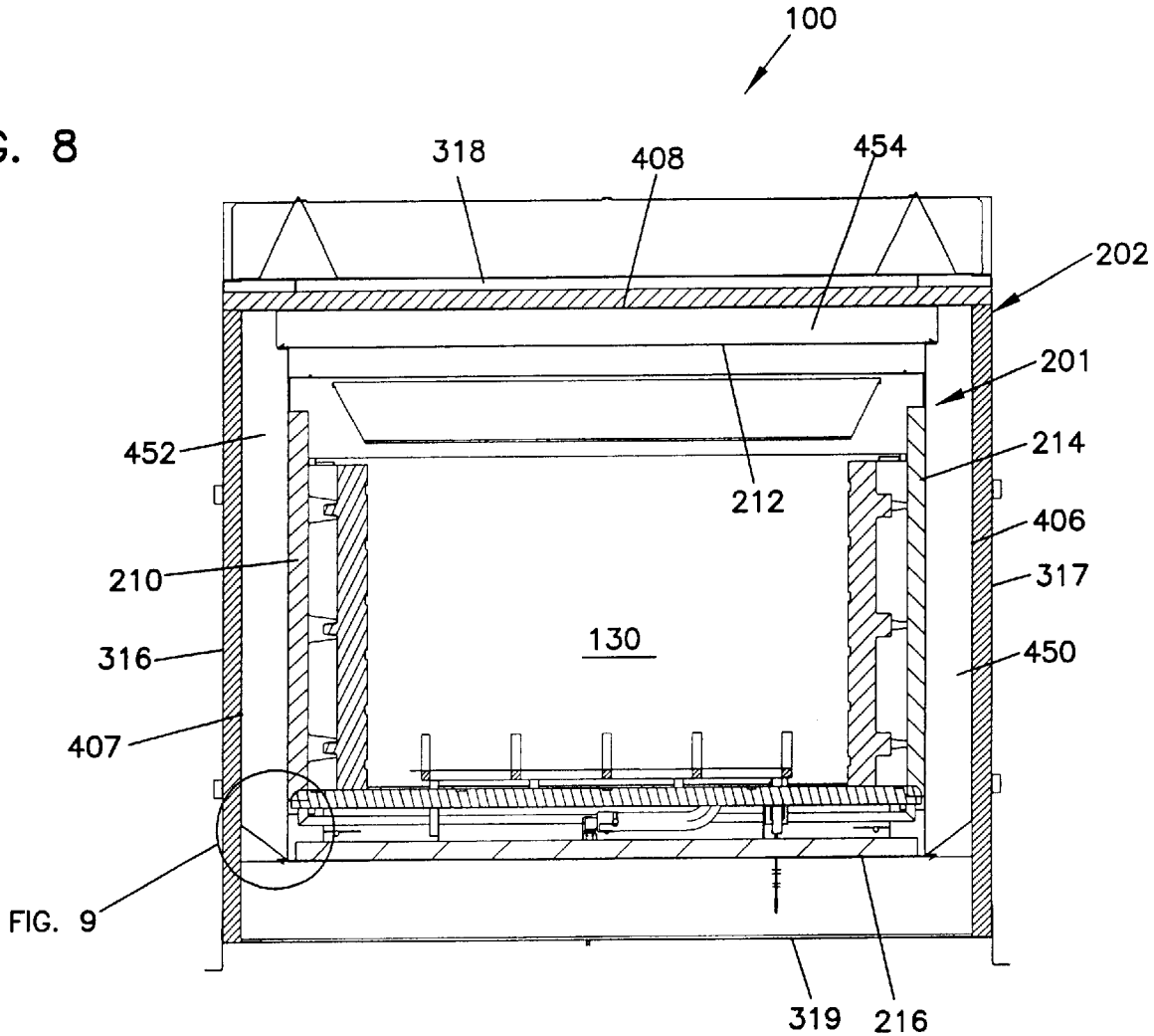
FIG. 8 is a schematic cross-sectional view in elevation of the fireplace of FIG. 1 showing an exemplary embodiment of a combustion air plenum system.
FIG. 9 is a schematic cross-sectional view in elevation of a portion of the combustion air plenum system shown in FIG. 8.
Figure 9:
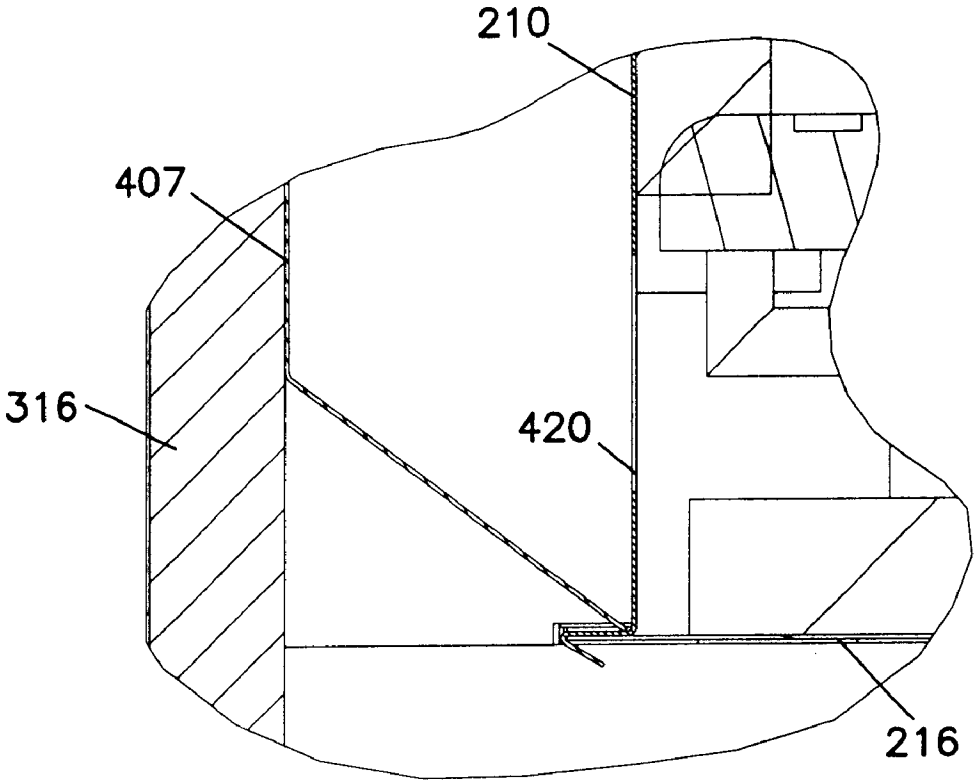

The structural elements comprising the combustion air plenum system for the fireplace 100 are shown in FIG. 7, and the pathways of the plenum system are illustrated in the cross-sectional schematic view in elevation shown in FIGS. 8 and 9. The combustion air plenum system is generally defined as one or more panels defining a space through which air may flow. The combustion air plenum system is formed to direct air for the outside of the structure 102 into the combustion chamber 130 for combustion and also to direct combusted air from the combustion chamber to the outside of the structure.

An exemplary embodiment of the combustion air plenum system illustrated in FIGS. 7–9 includes right and left air plenum panels 406 and 407 coupled to the panels 210 and 214 and the right and left splines 414 and 413, thereby defining right and left air plenum pathways 450 and 452, respectively. A top air plenum panel 408 is coupled to the outside of the panel 212, thereby defining a top air plenum pathway 454 coupled to pathways 450 and 452. Openings 420 and 422, defined in panels 210 and 214 of the combustion chamber enclosure 201, provide fluid communication between the pathways 450 and 452 and the combustion chamber 130.

Figure 11:
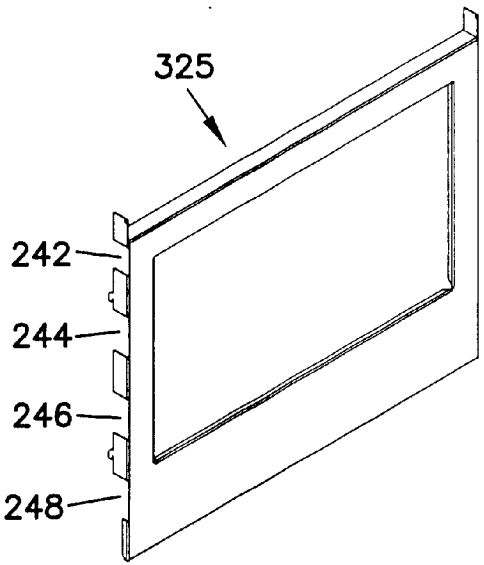
FIG. 11 is a perspective schematic view in isolation of the outside door of FIG. 6.
Figure 10:
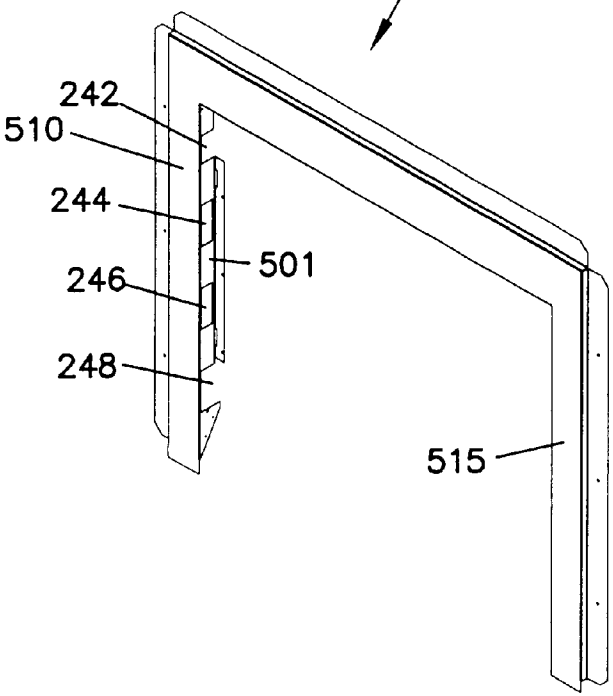
FIG. 10 is a perspective schematic view in isolation of the outdoor surround of FIG. 6.

In this structural arrangement, fresh air from the outside of the structure 102 may enter the exemplary combustion air plenum system via the openings 242, 244, 246, and 248 defined in the outside door 325 and the outdoor surround 312 (see FIGS. 10 and 11). The fresh air then enters the pathways 450 and 452 defined by the right and left air plenum panels 406 and 407. The fresh air may generally flow through the pathways 450, 452, and 454 and may further be drawn into the combustion chamber 130 via the openings 420 and 422 in the combustion chamber enclosure 201. The fresh air is then combusted by the burner 200.

Once combustion has occurred, the combusted air may rise and travel upward along the baffle 402, eventually being exhausted from the combustion chamber 130 via the exhaust opening 250.

The exemplary combustion air plenum system of the fireplace 100 may exhibit one or more of the following beneficial characteristics. The combustion air plenum system may shield the combustion chamber from any wind current or other disruptions that may be generated by the fresh air from the outside of the structure 102. This allows fresh air to be taken into the fireplace 100 without causing problems such as blowouts to the burner 200. Further, the plenum system eliminates the need for any intake vent piping. In addition, the exemplary plenum system provides sufficient fresh air to the burner 200 to maintain combustion.

Apart from the combustion air plenum system carrying fresh air from the outside of the structure 102 to the combustion chamber 130, additional opening 260 is defined by the combustion chamber enclosure facing the inside of the structure 101, as shown in FIG. 5. The opening 260 allows room air, or the air present in the inside of the structure 101, to enter the combustion chamber enclosure 201 as a secondary source of combustible air.

An additional opening 261, although not open to air flow in the preferred embodiment shown, may alternatively be opened to fluidly couple the inside of the structure 101 to a heat exchanger 252 formed by the panel 212 of the combustion chamber enclosure 201 and the baffle 402 disposed within the combustion chamber enclosure 201. If utilized in this configuration, the baffle 402 may be modified to perform as the top panel of the combustion chamber enclosure. Room air may enter the heat exchanger 252 via the opening 261 and be warmed as the baffle 402 is warmed by the combusted air rising from the burner 200. The warmed room air may also exit the heat exchanger 252 via the opening 261, thereby providing warmed air into the inside of the structure 101.

Referring now to FIGS. 10 and 11, the outdoor surround 312 and the outside door 325 are shown in perspective isolation. The openings 242, 244, 246, and 248 (also shown in FIG. 5 above) are defined by a flange 501 formed by a first side 510 of the outdoor surround 312. Similar openings are also formed on a flange coupled to a second side 515 of the outdoor surround 312. As explained above, fresh air from the outside of the structure 102 may enter the combustion air plenum system of the fireplace 100 via these openings 242, 244, 246, and 248.

Figure 12:
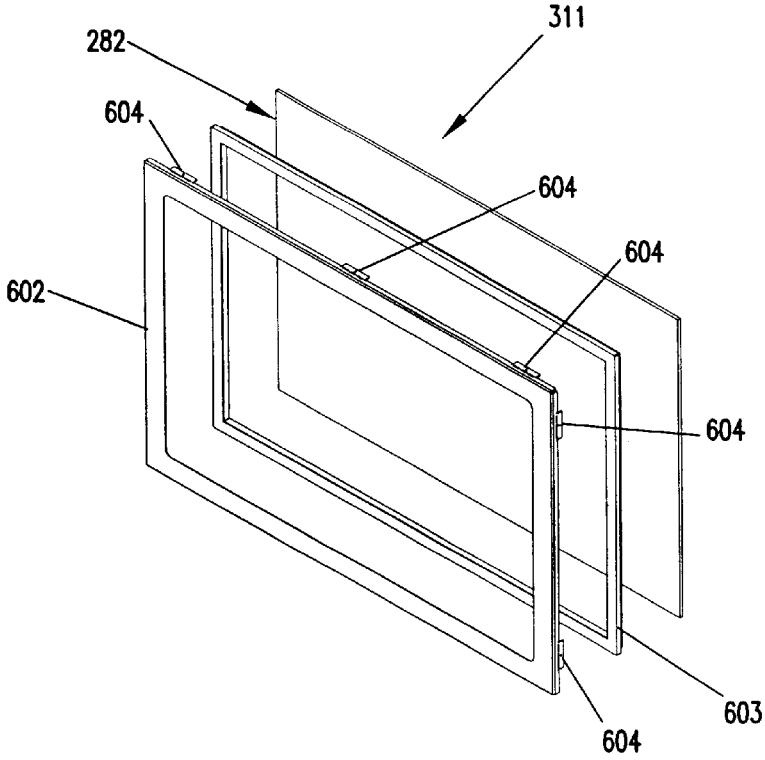
FIGS. 12 and 13 are perspective and cross-sectional schematic views, respectively, of the glass assembly of FIG. 6 including a panel, frame, and gasket.
Figure 13:
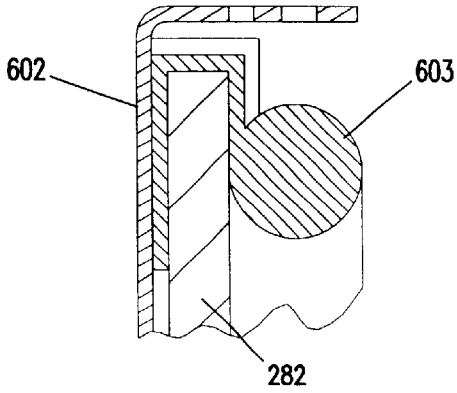

An assembly, such as assembly 311 (assembly 330 has a similar structure), is shown in FIGS. 12 and 13. The assembly 311 includes the outside front panel 282, a frame 602, and a gasket 603. The outside front panel 282 may be formed of any translucent material, such as glass, including, for example, glass ceramics, regular glass, tempered glass, etc. The outside front panel 282 is fitted into brackets 604 formed on the periphery of the frame 602. The gasket 603 is sandwiched between the outside front panel 282 and the frame 602 to seal the assembly 311 and reduce any air moving through the assembly 311.

Figure 14:
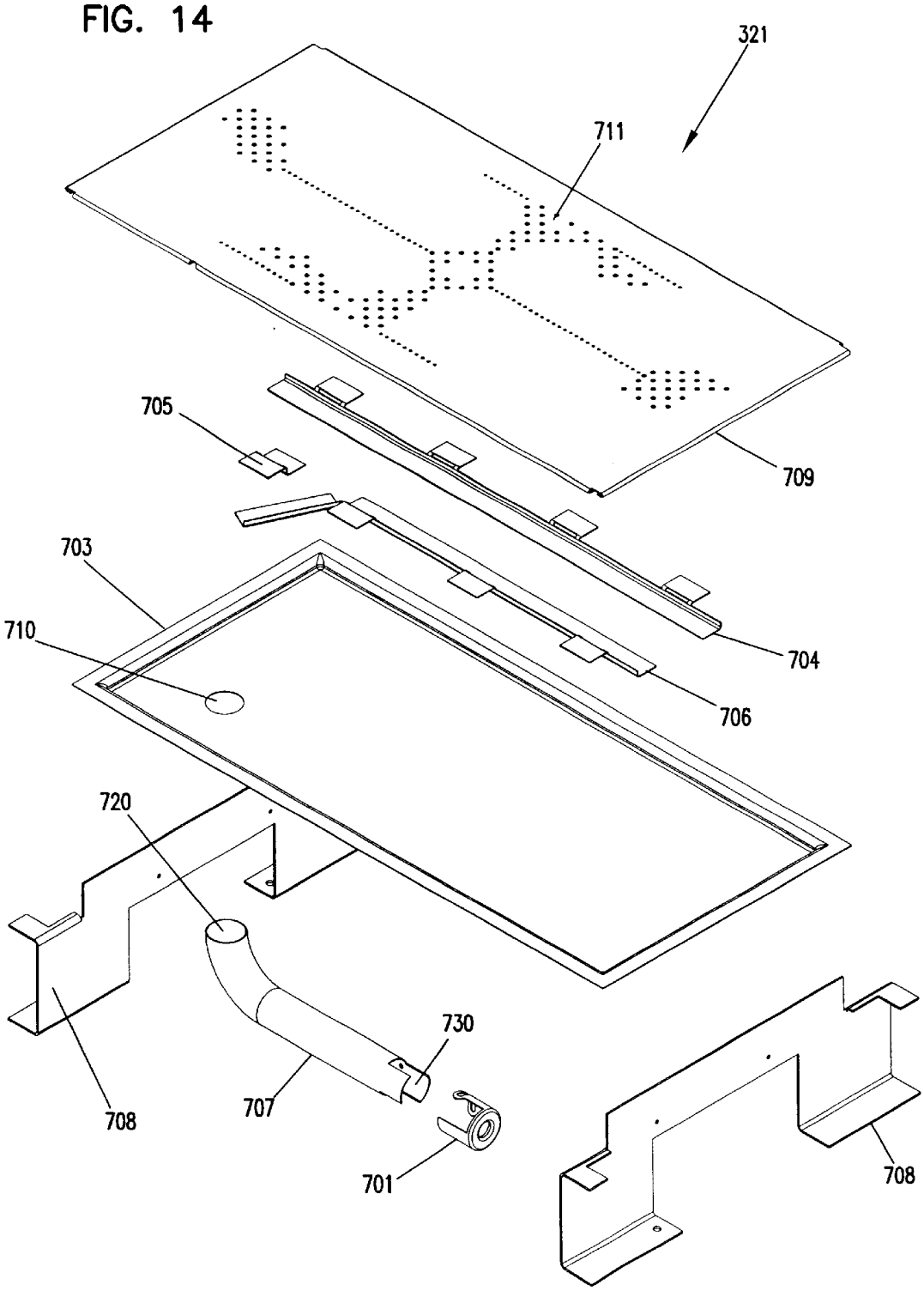
FIG. 14 is an exploded perspective schematic view of the burner assembly of FIG. 6.
Figure 15:
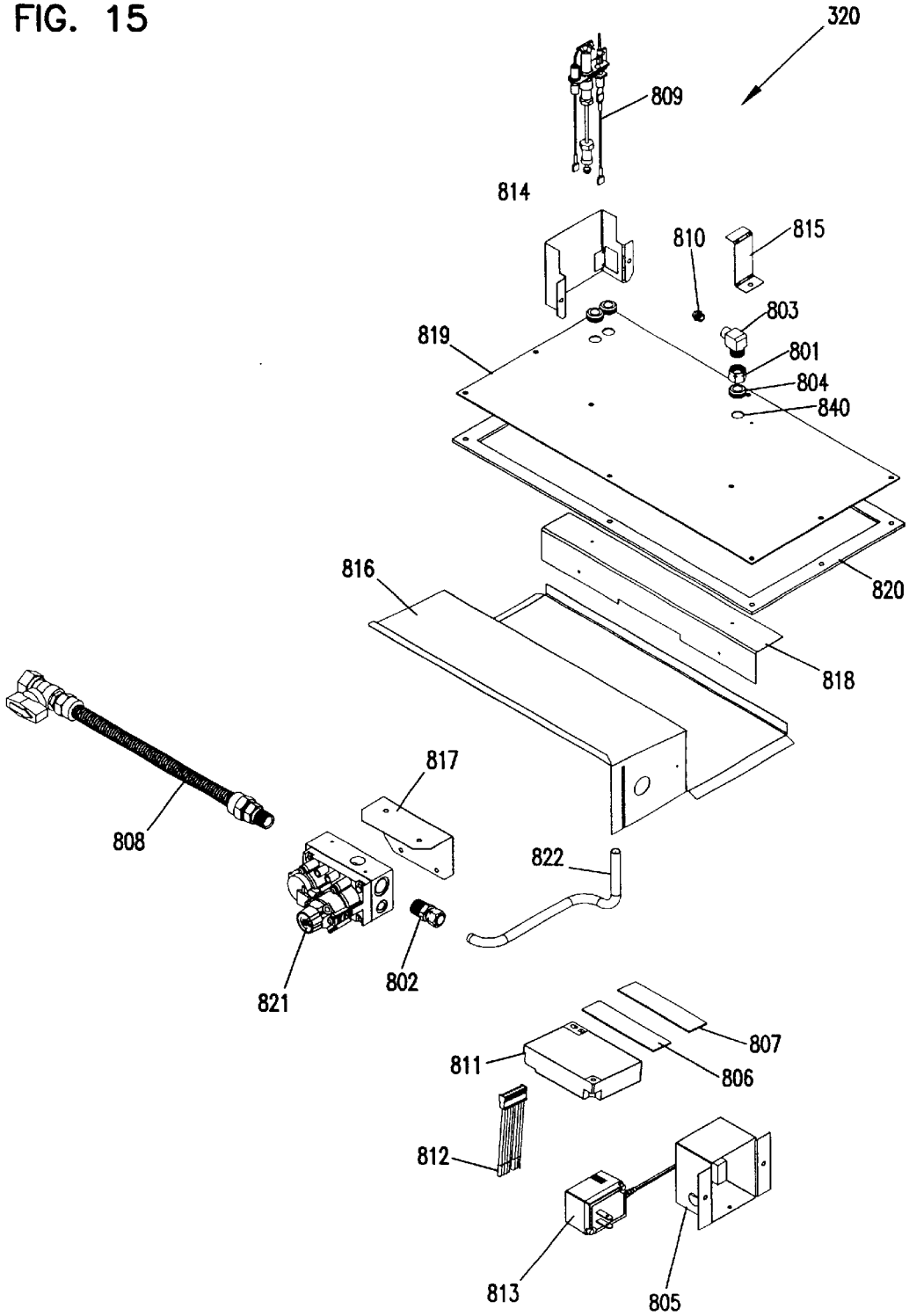
FIG. 15 is an exploded perspective schematic view of the valve assembly of FIG. 6.

Referring now to FIGS. 14 and 15, exploded views of the burner assembly 321 and the valve assembly 320 are shown. The burner assembly 321 includes a burner pan 703 with a burner deflector 704, a burner diffuser 706, and a burner support 705 disposed within the burner pan 703. A burner top 709 is coupled to the top of the burner pan 703. The burner top 709 includes apertures 711 defined through the burner top 709 in a predetermined pattern. This predetermined pattern may be modified to alter the characteristics of the flame pattern resulting from combustion.

A burner tube 707 is positioned below the burner pan 703. A first end 720 of the burner tube 707 is coupled to the burner pan 703 at an aperture 710 defined in the burner pan 703. An air shutter 701 is coupled to the opposite end 730 of the burner tube 707. A pair of burner legs 708 supports the burner pan 703 and related structures.

The valve assembly 320, shown in FIG. 15, includes a valve plate 819 and a valve plate gasket 820 coupled to the valve plate 819. A valve L-bracket 818 is coupled to the bottom of the valve plate 819 on a first side and to a valve bracket 816 on a second side. A control module 11, which functions to control an electronic pilot 809, includes a wire assembly 812 and a junction box assembly 805 coupled to a 3-volt adaptor plug 813. The control module 11 is coupled to a bottom side of the valve bracket 816 via Velcro strips 806 and 807.

A valve assembly bracket 817 is coupled to an opposite side of the valve bracket 816. A variable valve 821, which functions to adjust the amount of combustible gas provided to the burner assembly 321, is coupled to the bracket 817, with a flex piping 822 coupled via a brass fitting assembly 802 to a first end of the variable valve 821. A flex ball valve assembly 808 is coupled to a second end of the variable valve 821. The flex ball valve assembly 808, in turn, can be connected to a source of combustible gas.

Disposed on the valve plate 819 is a pilot assembly bracket 814 coupled to the electronic pilot 809. Also positioned on the valve plate 819 is a Z-bracket 815. Coupled to the valve plate 819 adjacent to the Z-bracket 815 is a compression elbow fitting 803 coupled on a first end via a brass fitting 801 and a grommet 804 to an aperture 840 defined in the valve plate 819. The grommet 804 is coupled through the aperture 804 to the flex piping 822. A second end of the compression elbow fitting 803 is coupled to the burner pipe 707 via the air shutter 701.

With the valve assembly 320 and the burner assembly 321 configured in this manner, combustible gas from a remote source is supplied via the flex ball valve assembly 808 to the variable valve 821. The variable valve 821 supplies the combustible gas via the flex piping 822 to the compression elbow fitting 803, which is, in turn, coupled to the burner tube 707. The burner tube 707 directs the combustible gas to the burner pan 703, where combustion occurs.

A variety of combustible gases may be used, such as LP or natural gas. In addition, other forms of combustible material may be used, such as wood or artificial logs. Alternatively, the burner assembly 321 and the valve assembly 320 may be supplemented or replaced with artificial means such as a glowing ember bed and/or artificial flame elements.

Figure 16:
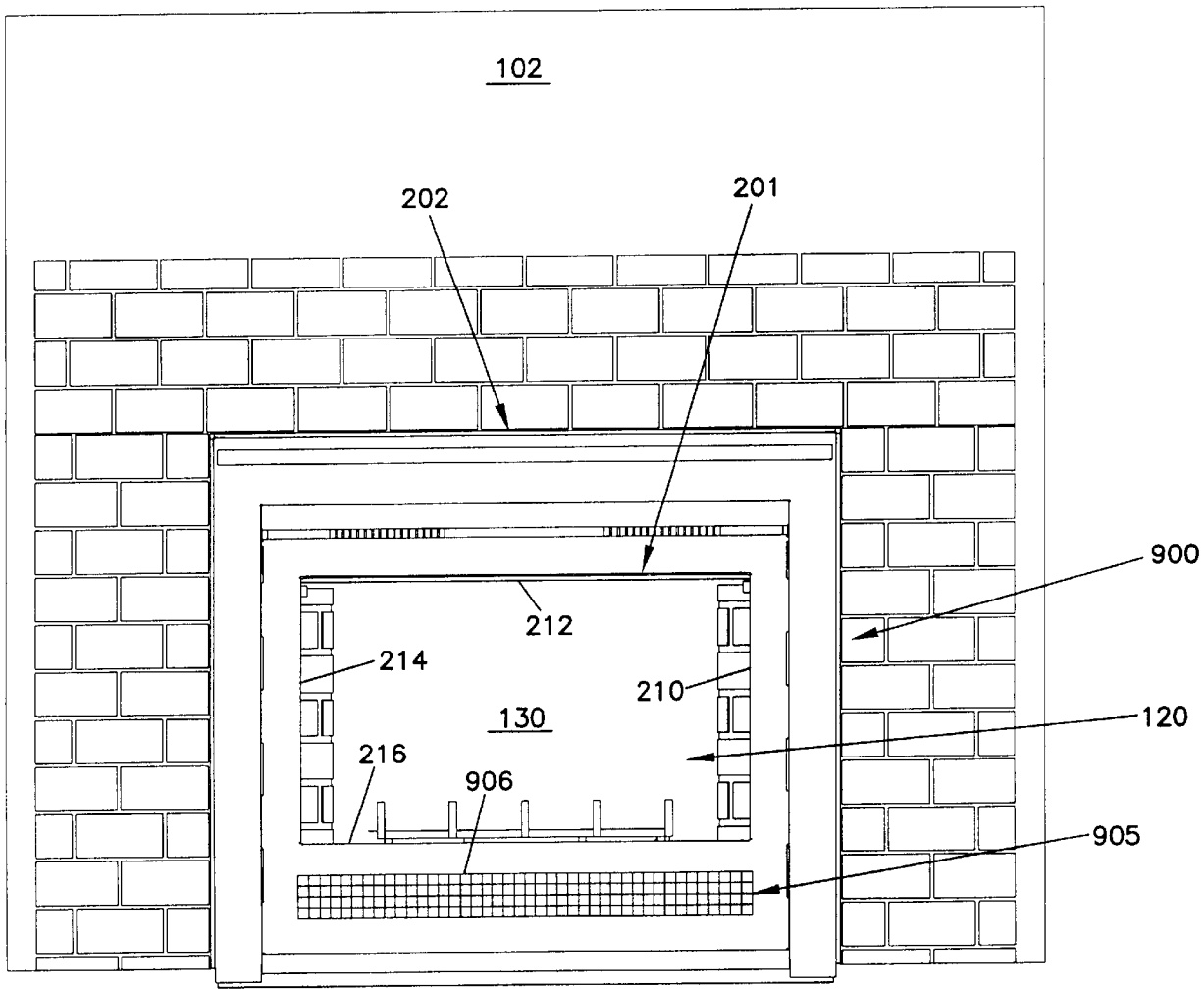
FIG. 16 is a front schematic view, taken from the outside of a structure, of a second embodiment of a fireplace installed in a wall of the structure in accordance with the present invention.
Figure 17:
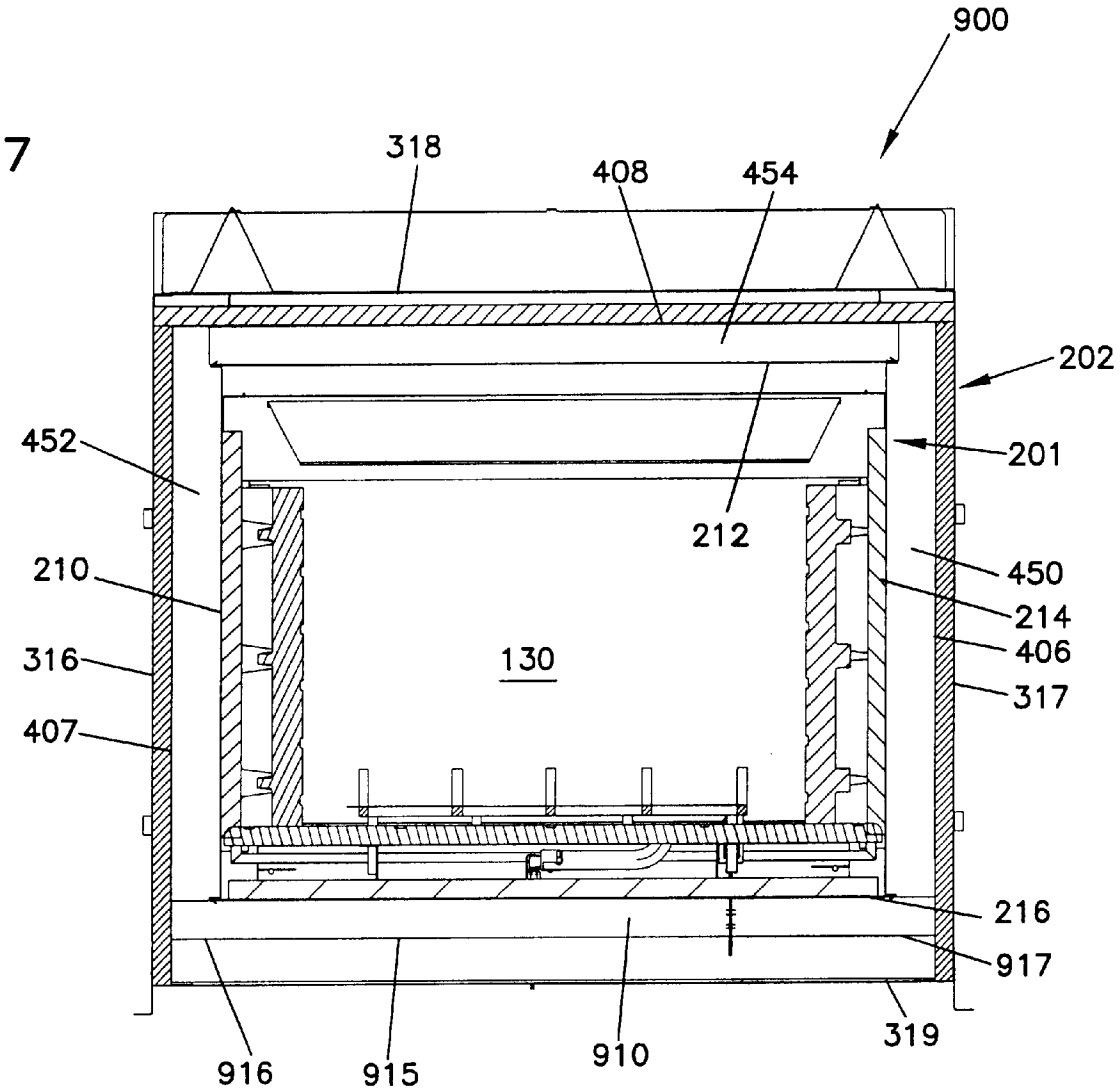
FIG. 17 is a schematic cross-sectional view in elevation of the fireplace of FIG. 16 showing a second exemplary embodiment of a combustion air plenum system.

A second exemplary embodiment of a fireplace 900 made in accordance with the present invention is shown in FIGS. 16 and 17. The fireplace 900 is similar to the fireplace 100, except that an additional source of fresh air is provided via an opening 905 defined in the outside door 325 of the fireplace 900. A decorative mesh 906 generally overlays the opening 905. The mesh 906 functions to reduce or eliminate any pest infiltration and keeps the opening 905 free from obstruction.

The opening 905 is coupled to a pathway 910 that is defined between a bottom air plenum 915 and the panel 216 of the combustion chamber enclosure 201. A first end 917 of the bottom air plenum 915 is coupled to the right side air plenum 406, and a second end 916 of the bottom air plenum 915 is coupled to the left side air plenum 407. The pathway 910 is coupled to fresh air from the outside of the structure 102 via the opening 905 defined in the outside door 325. In this configuration, fresh air from the outside of the structure may enter the pathway 910 via the opening 905 in the outside door 325, and the fresh air may travel to either the first or second ends 917 and 916 and enter pathways 450 or 452. From pathways 450 and 452, the fresh air may enter the combustion chamber 130 via the openings 420 and 422.

It should be understood that additional plenum systems may also be used without departing from the invention. For example, in the embodiment of the fireplace 900 shown in FIGS. 16 and 17, one or more additional openings may be formed in the panel 216 of the combustion chamber enclosure 201 in fluid communication with the pathway 910 to allow fresh air to flow upward from the pathway 910 into the burner 200. Other configurations are also possible.

Various components described above are formed of materials that resist corrosion when exposed to condensation and other corrosive elements. In the example embodiment, the following components are preferably formed using stainless steel: the outside door 325, the outdoor surround 312, the outdoor glass clips 314, the frame 602, the base outerwrap panel 319, the hood 307, and the deflection plate 322. Other corrosive-resistant material may also be used. In this manner, the fireplace 100 may be exposed to condensation from the outside of the structure 102 without corroding.

The present invention should not be considered limited to the particular examples or materials described above, but rather should be understood to cover all aspect of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A fireplace for installation in a wall facing an outside of a structure, the fireplace comprising:

a combustion chamber enclosure defining a combustion chamber and an outside opening, wherein the combustion chamber is viewable from the outside of the structure through the outside opening;

a housing at least partially surrounding the combustion chamber enclosure, wherein the housing is sealed to reduce an amount of condensation entering the combustion chamber from the outside of the structure;

a combustion air plenum system coupled to the combustion chamber enclosure to supply fresh air from the outside to the combustion chamber; and an exhaust opening defined by the combustion chamber enclosure for exhausting exhaust air from the combustion chamber to the outside of the structure.

2. The fireplace of claim 1, further comprising an outside translucent panel covering at least a portion of the outside opening.

3. The fireplace of claim 1, wherein the combustion chamber enclosure further defines an inside opening directed toward an inside of the structure and an inside translucent panel covering at least a portion of the inside opening.

4. The fireplace of claim 1, further comprising an outdoor surround coupled to the fireplace on the outside of the structure, wherein the outdoor surround defines at least one opening through which fresh air passes from the outside of the structure into the combustion air plenum system.

5. The fireplace of claim 4, wherein the outdoor surround includes first and second generally vertical portions each coupled at respective ends to opposite ends of a horizontal portion to form a generally U-shaped configuration, and wherein each of the first and second vertical portions defines a plurality of openings through which fresh air passes.

6. The fireplace of claim 5, further comprising an outside door configured to hold the outside translucent panel, wherein the outside door defines a plurality of openings corresponding to the plurality of openings of the outside surround through which fresh air passes.

7. The fireplace of claim 1, wherein all of the exhaust air is exhausted through the exhaust opening to the outside.

8. A fireplace for installation in a wall facing an outside of the structure, the fireplace comprising:

a combustion chamber enclosure defining a combustion chamber and an outside opening directed toward the outside of the structure;

an outside translucent panel covering at least a portion of the outside opening;

insulation surrounding at least a portion of the combustion chamber enclosure to reduce an amount of outside air from the outside of the structure from entering an inside of the structure through the fireplace;

a housing at least partially surrounding the combustion chamber enclosure, wherein the housing is sealed to reduce condensation entering the fireplace from the outside of the structure;

a gas burner disposed within the combustion chamber enclosure;

a combustion air plenum system including right and left air plenum panels and the combustion chamber enclosure defining right and left air plenum pathways in fluid communication with the outside of the structure, wherein the right and left air plenum pathways provide fresh air from the outside of the structure to the combustion chamber for combustion; and an exhaust opening defined by the combustion chamber enclosure at a position adjacent an upper portion of the combustion chamber, the exhaust opening exhausting exhaust air from the combustion chamber to the outside.

9. The fireplace of claim 8, wherein the combustion chamber enclosure further defines an inside opening directed toward the inside of the structure, and an inside translucent panel covering at least a portion of the inside opening.

10. A combustion chamber enclosure for installation in a wall facing an outside of the structure, the combustion chamber enclosure comprising:

a combustion chamber defined by the combustion chamber enclosure, wherein the combustion chamber includes an outside opening directed toward the outside of the structure, and wherein the combustion chamber enclosure is sealed to prevent any exhaust air from entering an inside of the structure;

a burner disposed within the combustion chamber enclosure; and an exhaust opening defined by the combustion chamber enclosure, wherein the exhaust opening exhausts all of the exhaust air through the outside opening.

11. The combustion chamber enclosure of claim 9, wherein the combustion chamber enclosure further defines an inside opening directed toward the inside of the structure.

12. A fireplace viewable from an outside of a structure, the fireplace comprising:

a combustion chamber enclosure defining a combustion chamber and an outside opening, wherein the combustion chamber is viewable via the outside opening from the outside of the structure;

a combustion air plenum coupled to the combustion chamber enclosure with an air plenum panel and the combustion chamber enclosure defining an air plenum pathway of the combustion air plenum;

an outdoor surround coupled to the fireplace to surround the outside opening, wherein the outdoor surround defines at least one opening to provide fresh air to the combustion air plenum; and an exhaust opening defined by the combustion chamber enclosure for exhausting exhaust air from the combustion chamber to the outside of the structure, wherein all of the exhaust air is exhausted through the exhaust opening to the outside.

* * * * *

UNITED STATES PATENT AND TRADEMARK OFFICE

CERTIFICATE OF CORRECTION

PATENT NO. : 6,769,426 B2
DATED : August 3, 2004
INVENTOR(S) : Fier et al.

It is certified that error appears in the above-identified patent and that said Letters Patent is hereby corrected as shown below:

Column 11,
Line 18, "claim 9," should read -- claim 10, --

Signed and Sealed this

Twenty-sixth Day of April, 2005

JON W. DUDAS
*Director of the United States Patent and Trademark Office*